US008813457B2

(12) United States Patent
Underkofler et al.

(10) Patent No.: US 8,813,457 B2
(45) Date of Patent: Aug. 26, 2014

(54) GRID RUNNER TO PERIMETER TRIM CLIP

(75) Inventors: Abraham M. Underkofler, Waukegan, IL (US); Mark R. Paulsen, Beach Park, IL (US); Peder J. Gulbrandsen, Aurora, IL (US)

(73) Assignee: USG Interiors, LLC, Chicago, IL (US)

( * ) Notice: Subject to any disclaimer, the term of this patent is extended or adjusted under 35 U.S.C. 154(b) by 0 days.

(21) Appl. No.: 13/537,870

(22) Filed: Jun. 29, 2012

(65) Prior Publication Data

US 2014/0000205 A1 Jan. 2, 2014

(51) Int. Cl.
*E04B 9/12* (2006.01)

(52) U.S. Cl.
USPC ..... 52/712; 52/506.07; 52/655.1; 248/316.7; 248/221.11

(58) Field of Classification Search
CPC . E04B 9/127; E04B 2001/2415; E04B 9/067; E04B 9/30; E04B 9/00; E04B 1/2608
USPC ..... 52/712, 506.07, 655.1, 665, 718.01, 52/506.06, 220.6; 403/230, 353; 248/323, 248/316.7, 220.22, 221.11, 222.52, 223.41
See application file for complete search history.

(56) References Cited

U.S. PATENT DOCUMENTS 3,677,589 A * 7/1972 Roles ..... 403/217
3,798,865 A * 3/1974 Curtis ..... 52/665
4,744,188 A 5/1988 Ahren
5,046,294 A * 9/1991 Platt ..... 52/506.06
5,195,289 A 3/1993 LaLonde et al.
5,201,787 A 4/1993 LaLonde et al.
5,572,844 A * 11/1996 Stackenwalt et al. ..... 52/506.07
5,669,198 A * 9/1997 Ruff ..... 52/656.4
5,857,306 A * 1/1999 Pellock ..... 52/643
5,937,605 A * 8/1999 Wendt ..... 52/506.06
7,293,393 B2 * 11/2007 Kelly et al. ..... 52/665
7,552,567 B2 * 6/2009 Ingratta et al. ..... 52/506.07
D612,224 S 3/2010 Wendt
7,673,429 B2 * 3/2010 Frecska ..... 52/506.07
7,788,875 B2 * 9/2010 Wendt ..... 52/712
7,930,864 B2 4/2011 Wendt
8,341,913 B2 * 1/2013 Meres et al. ..... 52/506.06

(Continued)

FOREIGN PATENT DOCUMENTS

GB 994701 6/1965
GB 1042101 9/1966

OTHER PUBLICATIONS

International Search Report and Written Opinion of the International Searching Authority dated Oct. 9, 2013, issued in PCT/US2013/047286, filed Jun. 24, 2013.

*Primary Examiner* — Brian Glessner
*Assistant Examiner* — Jessie Fonseca
(74) *Attorney, Agent, or Firm* — Pearne & Gordon LLP

(57) ABSTRACT

A clip for mounting an elongated trim strip on ends of ceiling grid runners, having a right angle configuration with two intersecting legs, one leg adapted to laterally abut an end of a grid runner and the other being adapted to engage the trim strip, said other leg having oppositely extending upper and lower grips for reception into upper and lower opposing channels of the trim strip, the grips being relatively moveable, and a toggle arrangement for moving said grips away from one another, when retracted, the grips being capable of passing between the opposed channels, the toggle arrangement selectively maintaining said grips in an extended position to frictionally lock onto the opposed channels of the trim strip.

7 Claims, 4 Drawing Sheets

(56) References Cited

U.S. PATENT DOCUMENTS

| | | | | |
|---|---|---|---|---|
| 8,443,564 | B2 * | 5/2013 | Bankston, Jr. | 52/506.07 |
| 8,453,407 | B2 * | 6/2013 | Tedesco et al. | 52/506.06 |
| 2001/0032433 | A1 | 10/2001 | Harris | |
| 2005/0160696 | A1 * | 7/2005 | Kelly et al. | 52/712 |
| 2010/0095627 | A1 * | 4/2010 | Meres et al. | 52/506.07 |
| 2011/0146194 | A1 * | 6/2011 | Tedesco et al. | 52/665 |
| 2011/0283634 | A1 * | 11/2011 | Underkofler et al. | 52/167.1 |
| 2012/0017531 | A1 * | 1/2012 | Bankston | 52/506.05 |

* cited by examiner

GRID RUNNER TO PERIMETER TRIM CLIP

BACKGROUND OF THE INVENTION

The invention relates to suspended ceiling systems and, in particular, to accessories for mounting ceiling edge trim.

PRIOR ART

Suspended ceiling islands and soffits are frequently finished at their perimeter or edge with an elongated trim strip to conceal the ends of the suspended grid runners and edges of the tile and to obtain a desired visual effect. Clips or brackets have been devised to connect the ends of the grid runners to the trim strip. U.S. Pat. Nos. 4,744,188; 5,195,289; 5,201,787; and 7,930,864 disclose examples of prior art clips developed for this purpose. The clip shown in the last mentioned '864 patent is an example of a product intended to connect with trim strips having mounting channels on their concealed sides. This prior art clip and other known design which have a set screw to locate the trim in place can create a problem if the screw is over-tightened causing the trim strip to be permanently deformed. Another known type of clip arrangement incorporates a separate metal piece to distribute the screw forces over a large area to minimize distortion of the trim. The types of clips incorporating set screws have the added cost of their separate parts and their assembly. There is a risk that the screw can be cross-threaded, particularly if it is assembled by the ceiling grid installer. Moreover, there is a potential problem that the clip parts can be dropped by the installer who is trying to hold and align several elements together at the same time and trying to tighten a screw. From the foregoing, it can be understood that there is a need for a simplified clip that reduces the number of parts required and avoids the potential for over-tightening of a set screw.

SUMMARY OF THE INVENTION

The invention provides a one-piece clip for mounting trim strips on the ends of suspended ceiling grid runners. The clip avoids the cost and complications attendant with an assembly of multiple parts. The installer need only handle one element, namely the clip, and the clip can be initially assembled with the trim strip without the use of a tool. Once the parts are aligned, the clip is caused to lock the trim in place by simple lever-like manipulation with a screwdriver or similar tool.

More particularly, once the trim is located in the lengthwise direction, the clip is forced into a locked position by prying an integral lever and tab into tight engagement with the associated mounting channel. This is simply and quickly accomplished with a screwdriver or a similar tool.

The disclosed clip, on a leg thereof associated with the grid runner has a tab for locking the clip on the grid runner end without separate fasteners. The tab is insertable in a hole existing in a web of the grid runner. When the clip leg is seated laterally against the grid runner, the tab can be manually bent to fix the clip on the grid runner.

The disclosed clip, by avoiding the need for separate clip parts and fasteners, facilitates rapid assembly of the trim on the grid runners. Moreover, the clip installation requires minimal dexterity and skill to obtain high quality fit and finish.

DESCRIPTION OF THE PREFERRED EMBODIMENT

Figure 4:
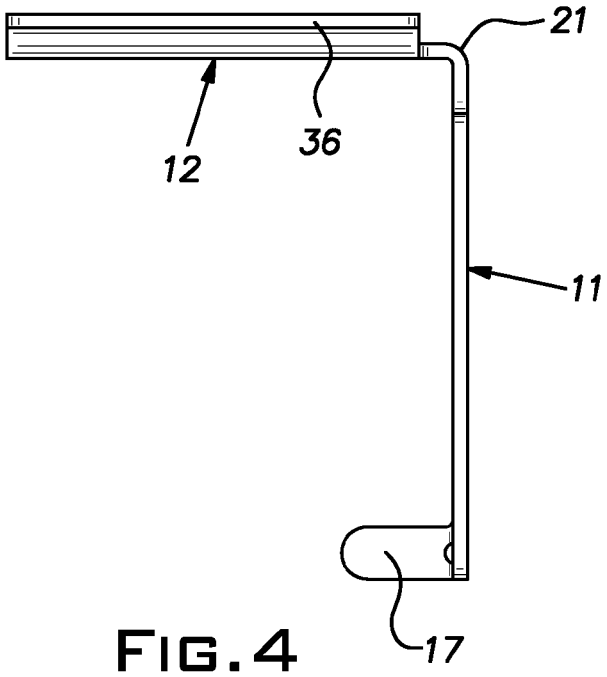
FIG. 4 is a top view of the clip.

A clip 10 embodying the invention has the general shape of a right angle bracket with perpendicular legs 11, 12. The clip 10 is shown, other than in FIG. 4, in its upright in-use orientation. The clip 10, preferably, is a rigid, one-piece stamping of sheet metal, for example, of 0.048 in. thick hot dipped galvanized steel. A first one 11 of the legs is adapted to be joined with a grid runner 13. The leg 11 is generally planar, with a pair of horizontally spaced holes 16 for receiving optional screws or rivets. At a distal end of the leg 11, there is formed a relatively narrow tab 17 extending horizontally from a horizontal bend line 18. A hole 19 interrupts the bend line 18 to facilitate manual bending of the tab 17 during installation of the clip 10.

The legs 11, 12 are joined at a vertical corner 21. The leg 12 is adapted to connect an elongated trim strip 20 of known construction that conceals the ends of laterally spaced parallel grid runners 13 and ceiling tiles at the perimeter of an island ceiling or at a soffit. The leg 12 has a main area 22 with planar portions 23 interrupted by vertical embossments 26, 27 that serve as stiffening elements. Slots 28, 29 and slits 31 form and surround a central lever 32. At its opposite sides, the lever 32 is connected to other parts of the main area 22 by lands or webs 33 which as will be described serve as a combined fulcrum and living hinge.

A lower end of the lever 32 is offset in the forward direction to form a depending tab 34 forward of the main area 22. Along an upper edge of the leg 12 is formed an upstanding tab 36 forward of the main area 22 and coplanar with the lever tab 34. A vertical slot 37 is formed in the leg 12 adjacent the corner 21.

The illustrated trim strip 20 is known in the art and is representative of various cross-sectional shapes to be selected by a ceiling designer. The trim strip 20 is an aluminum extrusion, typically 10 foot in length, having on its rear side 38, which is normally concealed in use, a pair of opposed longitudinally extending channels 39, 41 facing one another.

Figure 7:
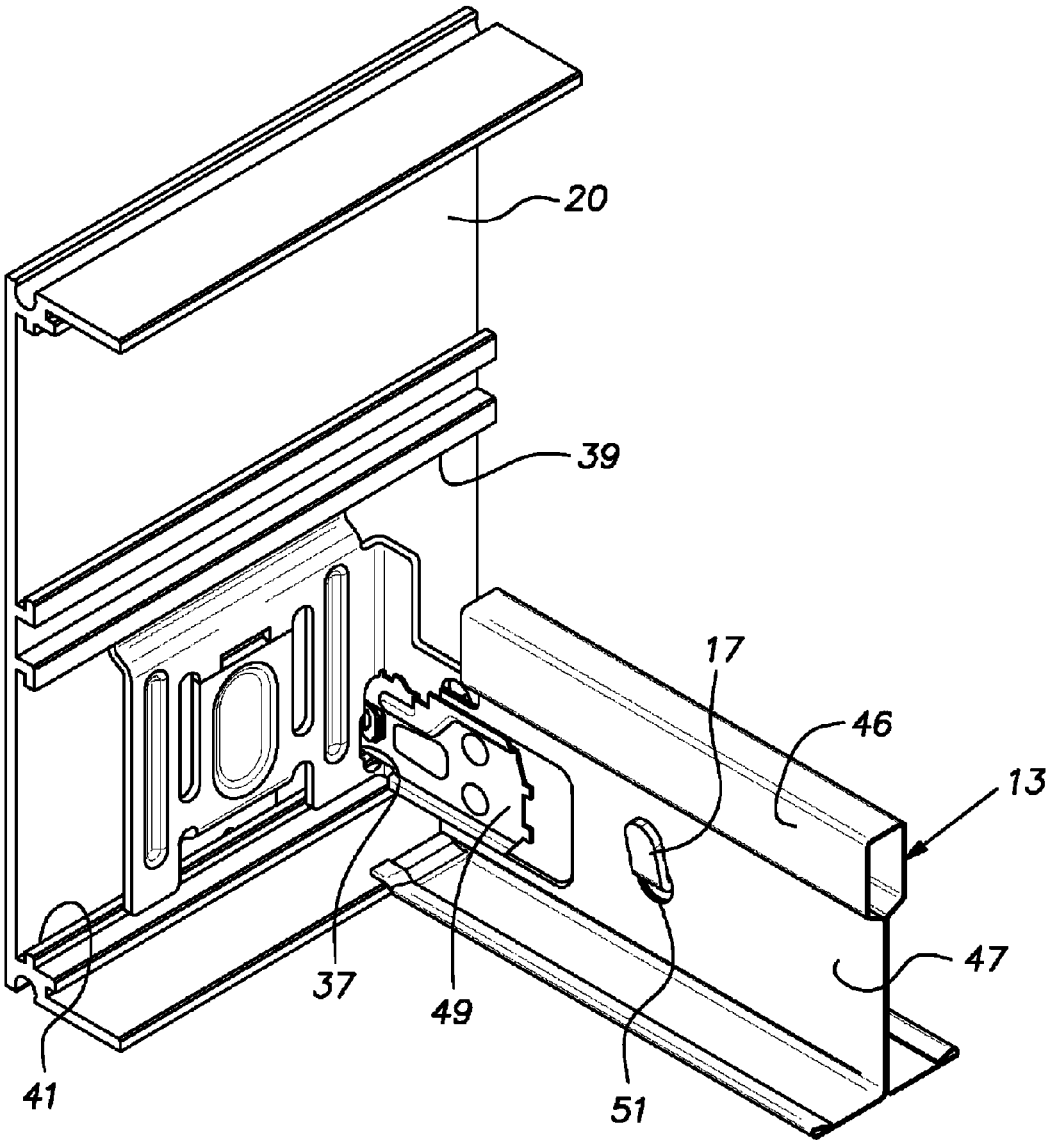
FIG. 7 is a perspective view of the clip assembled with a grid runner and a trim strip.

The illustrated grid runner 13 is a cross runner and has a conventional cross-section in the form of an inverted T and is commonly referred to as a grid tee. Other grid runner cross-sectional configurations can be used with the clip 10. The illustrated grid runner 13 has an upper reinforcing bulb 46, a vertical web 47 depending from the bulb and a horizontal flange 48 at the bottom of the web. The grid runner 13 includes an end connector 49 of known construction ordinarily used to join with an identical connector of another cross runner usually in a common slot of a main runner. The illustrated cross runner includes an indexing hole 51 rearward of the connector 49. Cross runners ordinarily will be spaced in parallel alignment on 2 ft. or 4 ft. centers, or industry metric equivalents. A clip 10 is mounted on the end of each cross runner 13 to collectively support a trim strip 20. In the simplest case, the clip 10 is mounted on a grid runner 13 by inserting its end connector 49 in the vertical slot 37 and the tab 17 through the indexing hole 51 and abutting the leg 11 against a side of the grid runner web 47. The clip 10 is locked in position on the grid runner 13 by bending the tab 17 upwardly as shown in FIG. 7. The vertical height of the leg 11 is proportioned to fit closely between the underside of the grid runner bulb 46 and the top of the grid runner flange 48 so that the clip is properly positioned or indexed to the grid runner 13.

Figure 5:
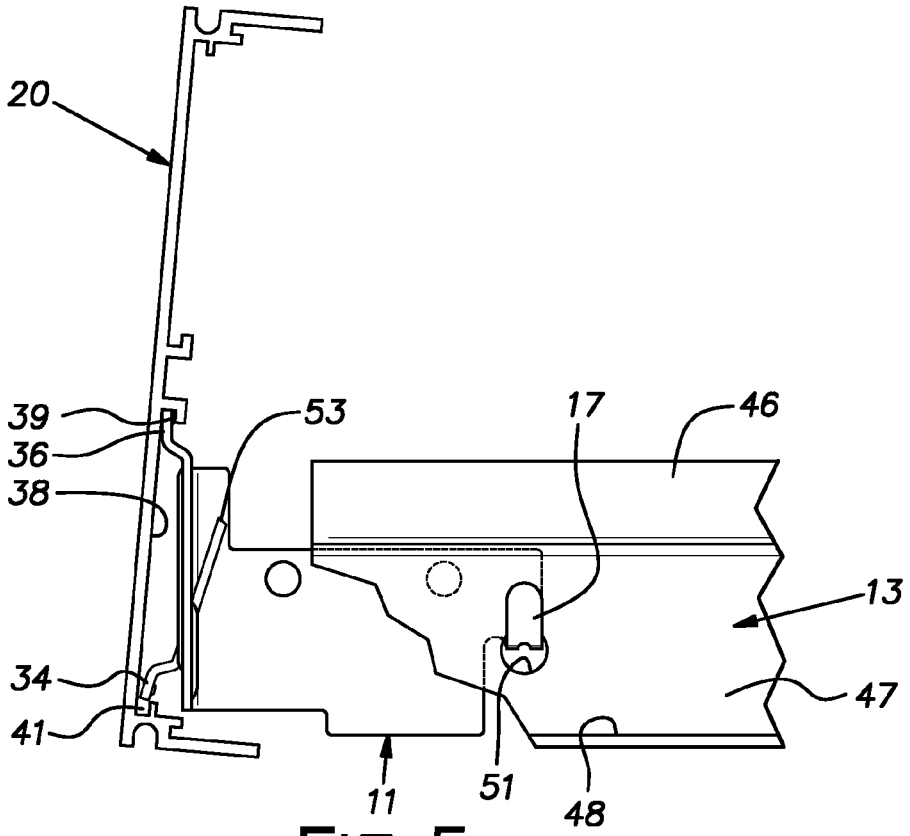
FIG. 5 is a side view of the clip in a first stage of assembly with the trim strip.
Figure 6:
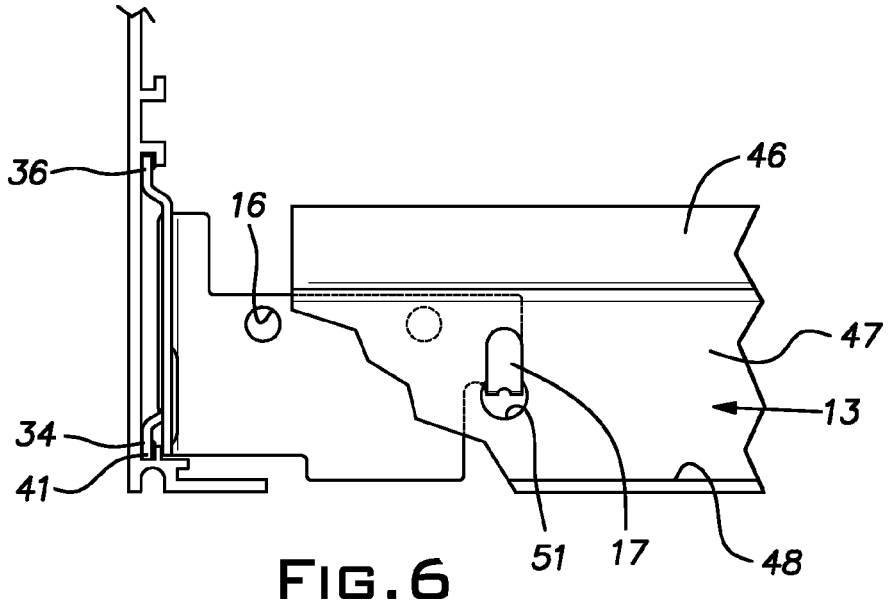
FIG. 6 is a side view of the clip showing the assembly of the clip and trim strip after completion of the second stage.

The trim strip 20 can be mounted on the clips 10 in a two step process. The trim strip 20 is first hung on the clips 10 by lowering the upper mounting channel 39 onto the upper clip tabs or grips 36. During this initial step, the central lever 32 is in a position illustrated in FIG. 5 where an upper end 53 is displaced rearward of the main area 22 of the leg 12. The lower end of the lever 32 represented by the depending tab or grip 34 is forward and upward from a final position where it lies in the same vertical plane as the upper tab 36 and is vertically farthest from the upper tab. The clip 10 may be supplied from the manufacturer with the displaced position of the lever 32 illustrated in FIG. 5.

Figure 1:
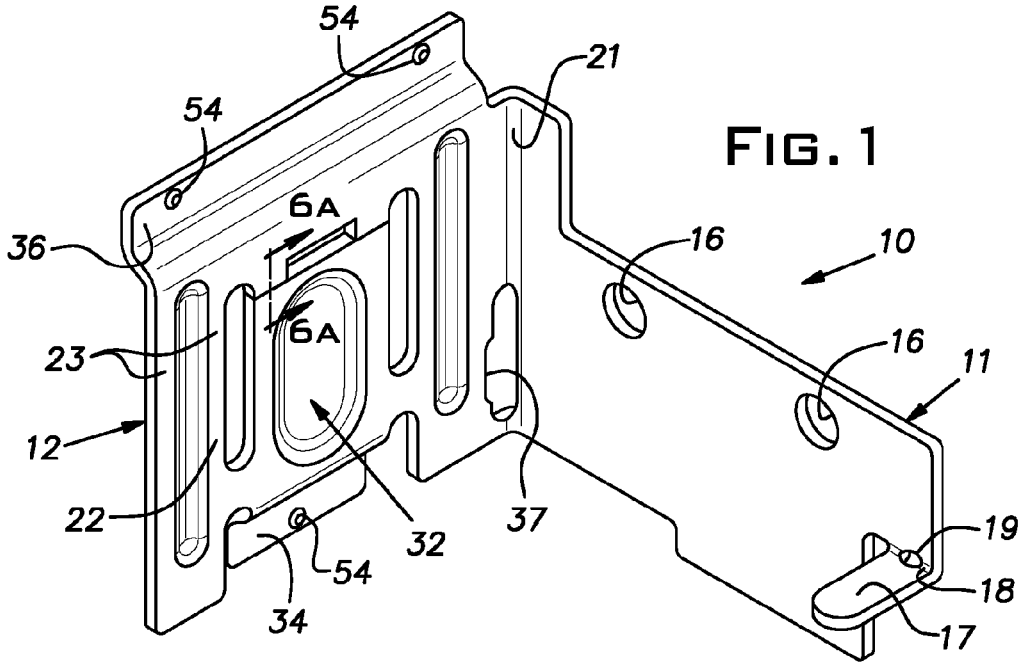
FIG. 1 is a perspective view of a clip constructed in accordance with the invention.
Figure 2:
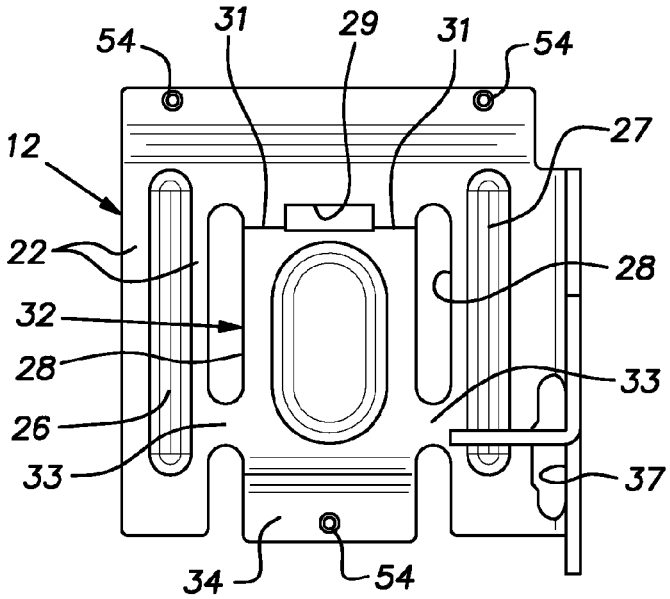
FIG. 2 is a rear elevational view of the clip.
Figure 6A:
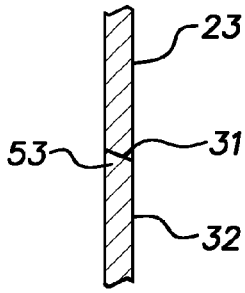
FIG. 6A is a greatly enlarged cross-sectional view of an area of a lever and overlying port of an associated leg.
Figure 3:
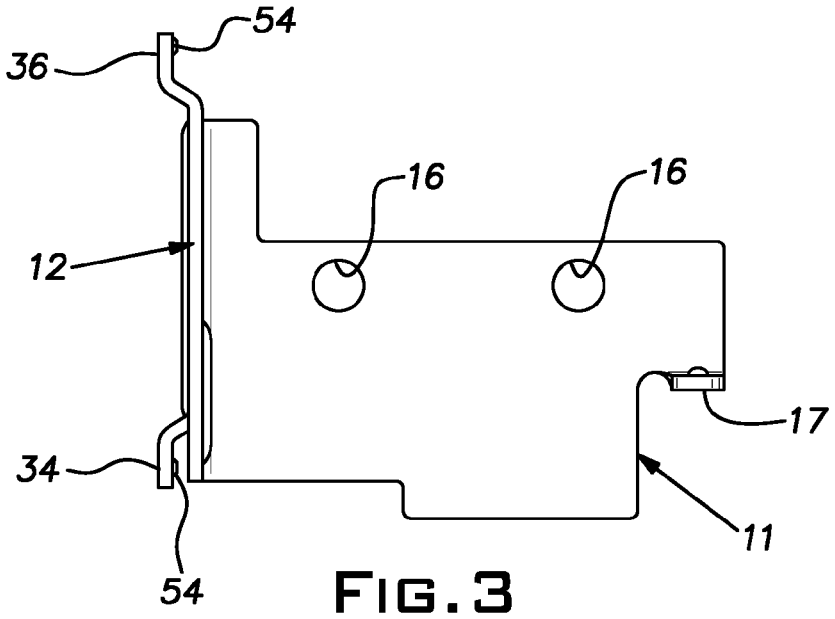
FIG. 3 is a side elevational view of the clip.

With the upper tab 36 seated in the upper trim strip channel 39, the lever 32 can be manually pushed, for example, with a screwdriver in contact with the depression in the center of the lever above the lands 33 until the upper end 53 contacts a part of the leg 12 overlying the slits 31. This motion of the lever 32 swings the lower tab 34 into the lower trim strip channel 41 to provisionally capture the trim strip 20 on the clip 10. Lengthwise adjustment of the strip 20 can be made at this time. When the longitudinal position of the strip 20 is correct, the lever 32 is forced back into the plane of the main area 22 of the leg 12 causing the lower tab 34 to move vertically downwardly away from the upper tab 36 and thereby frictionally lock the tabs to the respective channels 41, 39 with an interference fit. FIG. 6A is a greatly enlarged cross-sectional view of the geometry of the slits 31. Preferably, as shown in FIG. 6A with some exaggeration, the slits 31 are inclined upwardly from the rear to the front of the clip leg 12. The lever 32 pivots on the lands 33 with the lands acting as a living hinge. The undercut or inclined geometry of the slits 31 along with an interference fit created by proportioning the clip to be oversized to the channel to channel dimension prevent the lever from unintentionally moving back to its initial position where the lever is out of the plane of the main area 22. A flat blade screwdriver (not illustrated) can be used to toggle or pry the lever from its initial out of plane condition into the final position where it is coplanar with the remainder of the main area 22. The blade of the screwdriver is inserted in the central slot 29 to permit this prying action. The lands 33, in addition to working as a living hinge, operate as a fulcrum and cause the lower part of the lever represented by the depending tab 34 to swing into the lower trim strip channel 41. When the upper end 53 of the lever 32 is forced over center of the slit surface of the main or planar portion of the leg 12, interference caused by the slit geometry strongly resists a reverse or unlocking movement of the lever The clip 10 can be used with main runners or with cross runners that are less than full length and do not have the end detail described above. In this case, the tab 17 can be bent back into the plane of the remainder of the leg 11 and the holes 16 can accept self-tapping screws or rivets to secure the leg 11 to the web of the grid runner in question. Small projections 54 can be stamped in the tabs 34, 36 to improve the retention force of the clip 10 on the trim strip 20.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A clip for mounting an elongated trim strip on an end of a grid runner of a suspended ceiling, the clip, in use, having in plan view a right angle configuration formed by two intersecting legs, one of said legs being adapted to laterally abut the end of the grid runner and another of said legs being adapted to engage the trim strip, said another leg having integrally formed oppositely extending upper and lower grips offset from said one leg for reception into upper and lower opposing channels of the trim strip, the grips being relatively moveable towards and away from one another, and a toggle arrangement formed in the another leg for moving said grips away from one another, the toggle arrangement permitting the grips to occupy a stable self-maintaining retracted position in which they are capable of passing freely between the opposed channels, the toggle arrangement being constructed and arranged to be manually forced over center so that a part of the another leg interferes with reverse movement of one of said grips to thereby selectively maintain said grips in an extended position relative to one another in which they frictionally lock onto the opposed channels of the trim strip.

2. A clip as set forth in claim 1, wherein the toggle arrangement comprises a pivotally supported lever that can be manually toggled into an interference fit with surrounding clip structure.

3. A clip as set forth in claim 1, wherein said toggle arrangement is integrally formed with the body of the clip whereby the clip comprises a one-piece construction.

4. A clip as set forth in claim 1, wherein said toggle arrangement comprises a lever stamped out of a sheet metal body forming the clip, the lever being supported on the body by land areas serving both as a fulcrum and a living hinge, the lever having an associated tab that forms one of said grips.

5. A clip as set forth in claim 4, including a slot for receiving a flat blade of a screwdriver for toggling said lever into a locked position.

6. A clip as set forth in claim 1, wherein said one leg includes a bendable tab distal from said another leg adapted to be inserted in a hole in a web of said grid runner and thereafter bent to lock said one leg onto said grid runner.

7. A clip as set forth in claim 6, wherein said another leg includes a vertical slot for receiving an end connector of the grid runner locked by said tab on said one leg.

* * * * *